United States Patent [19]

Welles

[11] 4,099,666

[45] Jul. 11, 1978

[54] COMPOSITE BAG FOR HARD CRUSTED BAKERY PRODUCTS

[76] Inventor: Theodore W. Welles, 20849 Halworth Rd., Shaker Heights, Ohio 44122

[21] Appl. No.: 810,300

[22] Filed: Jun. 27, 1977

[51] Int. Cl.[2] ..... B65D 33/16

[52] U.S. Cl. ..... 229/62; 229/87 B; 426/128

[58] Field of Search ..... 229/62, 87 B; 426/127, 426/128; 150/3

[56] References Cited

U.S. PATENT DOCUMENTS

| | | | |
|---|---|---|---|
| 2,048,213 | 7/1936 | Grogan | 426/128 |
| 2,098,258 | 11/1937 | Rowe | 229/62 |
| 2,476,564 | 7/1949 | Rosen | 426/128 |
| 2,899,347 | 8/1959 | Kindseth | 229/62 |
| 2,949,370 | 8/1960 | Hughes | 426/128 |
| 2,992,117 | 7/1961 | Rosen et al. | 426/128 |
| 3,092,502 | 6/1963 | Smith | 426/128 |
| 3,432,310 | 3/1969 | Weeks | 229/87 B |
| 3,552,637 | 1/1971 | Swinford | 206/554 |

FOREIGN PATENT DOCUMENTS

| | | | |
|---|---|---|---|
| 727,997 | 2/1966 | Netherlands | 229/62 |

*Primary Examiner*—Stephen P. Garbe
*Attorney, Agent, or Firm*—Meyer, Tilberry & Body

[57] ABSTRACT

A composite bag for crusted bread products is disclosed comprising a first portion in the form of a paper bag having a closed end and an open end, and a second portion of plastic film material bonded to and extending from the open end of the paper bag and providing a closable opening for the composite bag. The second portion is defined by sheets of plastic film having different lengths longitudinally with respect to the open end of the paper bag and bonded to the paper bag for one of the films to extend longitudinally beyond the other and provide an extension flap which facilitates supporting the bag during insertion of a bread article thereinto. The composite bag is produced by transferring a preformed paper bag laterally with respect to the axis thereof between plastic sheets which are bonded to the open end of the bag and then longitudinally seamed along lines contiguous with side edge folds of the paper bag.

13 Claims, 7 Drawing Figures

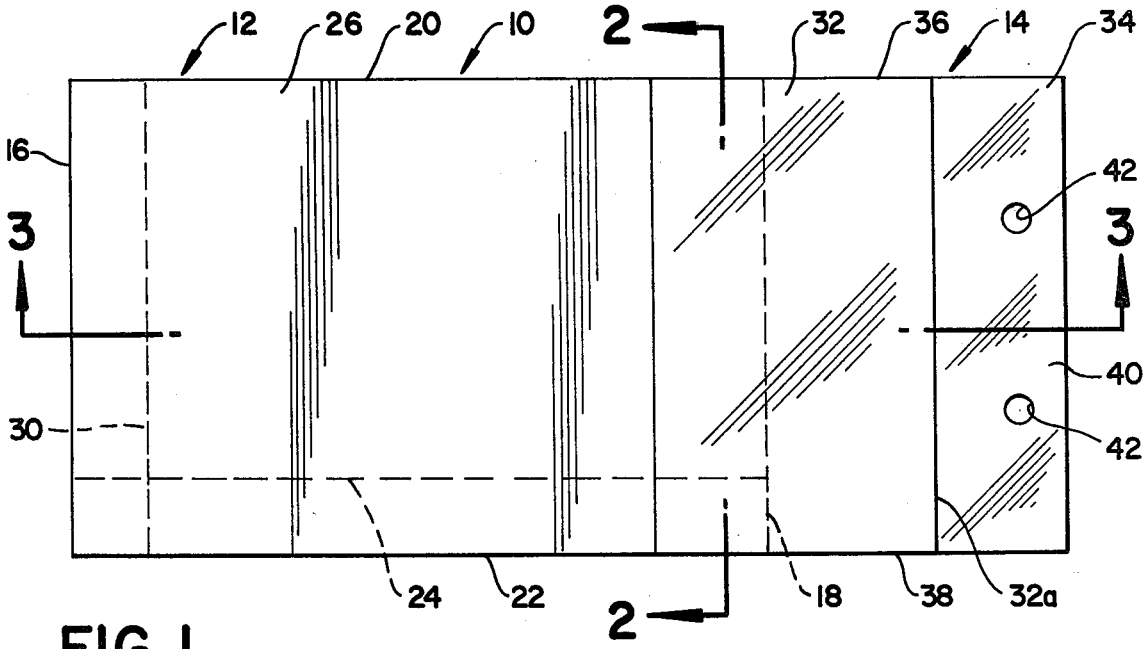
FIG. 1
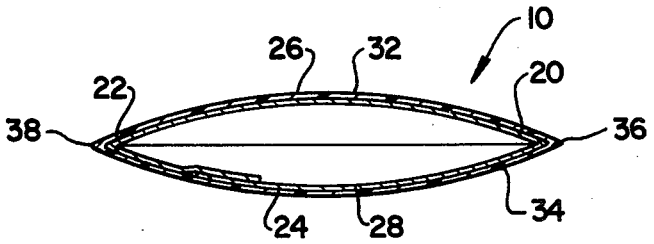
FIG. 2
FIG. 3
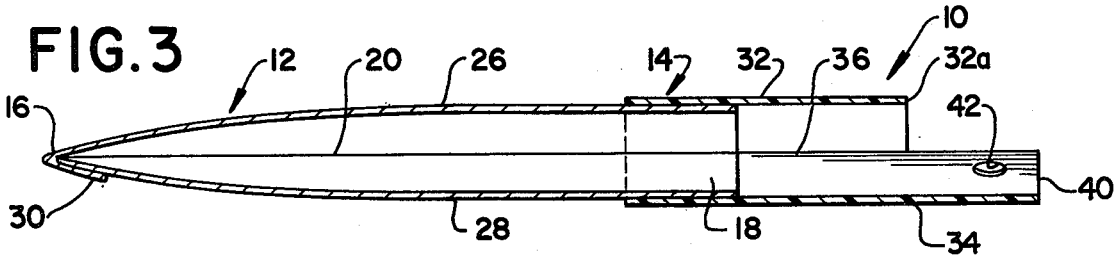
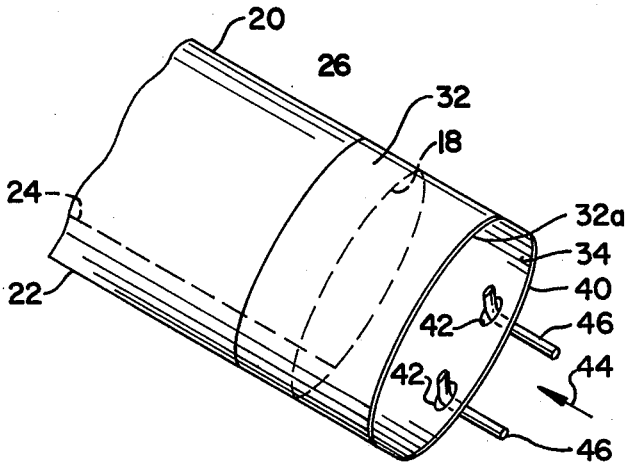
FIG. 4

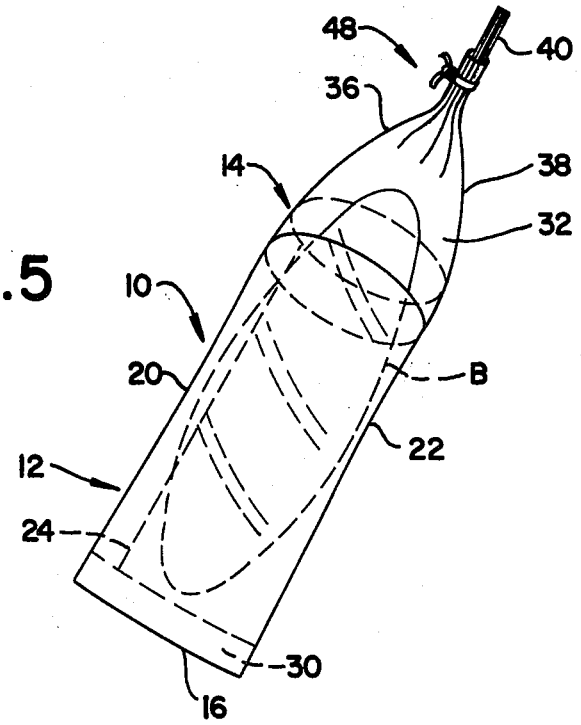
FIG.5
FIG.7
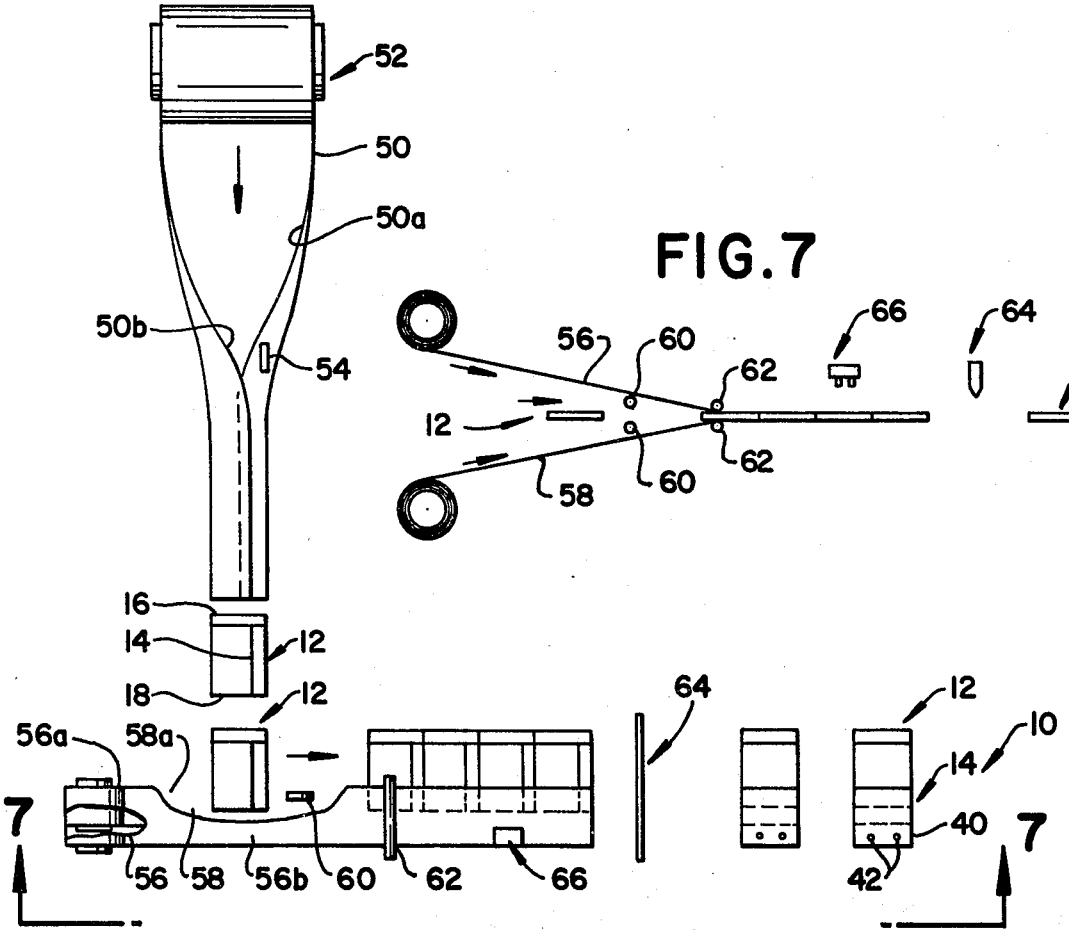
FIG.6

COMPOSITE BAG FOR HARD CRUSTED BAKERY PRODUCTS

This invention relates to the art of packaging bread products and, more particularly, to a composite paper and plastic bag for packaging hard crusted bread products.

The term hard crusted breads as used herein is with reference to a wide variety of bread products which are hearth baked in various shapes and sizes as opposed to those breads and bread products which are baked in pans. By way of example, ethnic styles of rye bread, French bread and Italian bread are among the more common hard crusted breads. These breads are generally not produced on a production line basis by large bakeries which daily supply supermarkets and the like with soft crusted sandwich type breads. Rather, they are most often produced by smaller bakeries for a somewhat selective clientele including restaurants as well as individuals, a majority of whom are connoissuers of the quality of such bread products. In this respect, for such connoissuers there is a particular taste and "feel in the mouth" of such hard crusted breads when the crust is of the proper hardness and dryness, and it is very important to such connoissuers that the breads have these characteristics at the time of purchase and that the characteristics can be maintained for a reasonable period of time thereafter in that consumption or total consumption may not be immediate. Accordingly, the packaging of such hard crusted bread products becomes extremely important both to the baker and to his customers. Packages or bags used must allow sufficient escape of moisture to prevent staling of the crust which is caused by moisture in the bag being absorbed by the crust and thus softening the crust. While the crust can again be made hard by heating, the taste of the crust is lost and will not come back.

Heretofore, hard crusted bread packagers used paper bags generally made from waxed or unwaxed kraft paper. The bag is long enough to allow folding or rolling up of the open end to close the latter, and the paper material has a sufficient rate of moisture escape to maintain the desired crust hardness and taste over a reasonable period of time. While such paper bags have served the purpose for a considerable number of years, they do have certain disadvantages and, under today's health standards, are objected to by health inspectors in connection with the storage and sale of bread products. In this respect, the open ends of the bags are generally closed merely by crimping or rolling over the open end of the bag, whereby the bag can come open when handled by a customer and whereby access to the bread for pinching or squeezing by a customer is readily attainable. Both situations of course are objectional from a health standpoint. Furthermore, the frangable nature of paper does not lend to the use of wire twist type fasteners or the like which would tend to keep the package closed and discourage the opening of the bag for purposes of pinching or squeezing the crust of the bread. Still further, connoissuers of such hard crusted bread products like to visually inspect the crust condition, and many will not buy a bread product unless they can see at least a portion of the crust. A completely closed and sealed paper bag of course prevents such inspection and thus is avoided by the bakery.

An all plastic bag, while acceptable for soft crusted bread products, is not acceptable for use in packaging hard crusted bread products. In this respect, the crust of such a bread product in a plastic bag will lose its taste and hardness about one-half hour to one hour following packaging. This is the result of the fact that the plastic material, generally polyethylene, allows a minimum amount of moisture escape whereby the crust quickly stales by absorbing the moisture trapped in the bag. Additionally, connoissuers of hard crusted bread products assert that the plastic ruins the taste of the crust. Such an all plastic bag is however looked favorably upon by health inspectors in that it enables visual inspection and a certain degree of squeezing of the bread product without direct customer contact therewith, and enables the bag to be maintained closed prior to purchase and use of the product such as by a wire twist type fastener.

In an effort to overcome the foregoing disadvantages of all paper and all plastic bags for packaging hard crusted bread products, some bakers put the bread product in a polyethylene bag and then place the polyethylene bag inside a paper bag so that the customer can use the paper bag once the product is bought. Such a packaging procedure is quite costly in that two bags are required and, more importantly, the bread product when enclosed in the polyethylene bag for only a short period of time as mentioned above becomes undesirable to the consumer. Other bakers have gone to the extent of using two paper bags, putting the bread into one bag and then putting the open end of the one bag into a second bag. Again, this is not acceptable from the standpoint of cost alone, and does not avoid the problem that the customer wants to at least see a portion of the product and to pinch or squeeze the crust to test the texture thereof. Still, prior to the present invention, these packaging arrangements were the only way to meet health standard requirements and, accordingly, were necessary.

Other problems in connection with the packaging of hard crusted bread products include the objection by health inspectors to the amount physical handling of the bread products and bag during a packaging process. In this respect, the bag is hand manipulated to open, the bread product is inserted into the bag by hand, and the bag is hand closed. The bags available do not lend to the use of standard packaging machinery. Further, the market is limited and the profit margin is small whereby, prior to the present invention, specialized packages or bags to solve the many problems have been economically impractical and unacceptable in that specialized as opposed to standard package making machinery is required to make the packages or bags. These problems have also contributed to discouraging large commercial bakeries from entering the market for hard crusted bread products.

In accordance with the present invention, a bag and method of producing the same is provided which advantageously avoids or overcomes the foregoing problems and others in connection with the packaging of hard crusted breads and bread products. More particularly, a bag made in accordance with the present invention can be closed and sealed such as by a wire twist type fastener or a plastic constricting type tag, thus to satisfy health standard requirements, and at the same time the bag allows sufficient moisture escape from within the bag to maintain the desired crust hardness. Moreover, the bag provides for the customer to see a portion of the bread product therein and/or to feel the product without physical contact therewith. Still further, the preferred bag structure enables the filling thereof to be achieved using standard packaging equipment thus to minimize handling of the bag and product and to reduce packaging time. Just as importantly, the bag structure enables the bag to be made using standard package making machinery, thus for the bag to be an economical item at a cost competitive with paper or plastic bags.

The foregoing attributes are achieved by providing a composite bag including a first portion of paper material having closed and open ends and a single longitudinal seam therebetween, and a second portion defined by two plastic films bonded to opposite sides of the open end of the paper portion and having corresponding side edges sealed together to provide the second portion with a pair of longitudinal seams. The plastic portion is constrictable to enable closing the bread product within the bag and enables viewing the product as well as feeling the same for texture of the crust. Preferably, the plastic only exposes a small portion of the end of the bread, whereby the majority of the bag enclosing the the bread is paper, thus allowing the desired moisture escape to maintain crust hardness.

Advantageously, the bag structure enables the composite bag to be produced using standard packaging making machinery. In this respect, the paper portion is produced as a standard paper bag having closed and open ends. Then the performed bag is transferred between films of plastic material which are bonded to the paper at the open end of the paper bag and cut and heat sealed along the side folds of the paper bag to in effect provide a plastic extension at the open end thereof. Preferably, one of the plastic films extends longitudinally beyond the other to provide a flap which facilitates supporting and opening the bag and inserting an article of bread therein.

It is accordingly an outstanding object of the present invention to provide a composite paper and plastic bag particularly suited for packaging hard crusted bread products.

Another object is the provision of a bag of the foregoing character which enables closing a bread product therein against accidental or casual opening while allowing sufficient moisture escape to maintain desired crust hardness and flavor.

Yet another object is the provision of a bag of the foregoing character which enables a bread product therein to be seen and/or felt without direct physical contact therewith and, at the same time, protects the contents of the bag from exposure to the surrounding environments.

Still another object is the provision of a composite bag of the foregoing character which does not require specialized manufacturing equipment of procedures and thus is economically competitive with respect to all paper or all plastic bags.

A further object is the provision of a composite bag of the foregoing character comprised of a preformed paper bag and a pair of plastic films bonded to the open end thereof and heat sealed together along edges having contiguity with side edge folds of the paper bag.

Still a further object is the provision of an improved method of making a composite paper and plastic bag.

Another object is the provision of a method of making a composite paper and plastic bag employing a preformed paper bag.

The foregoing objects, and other, will in part be obvious and in part pointed out more fully hereinafter in conjunction with the written description of preferred embodiments illustrated in the accompanying drawings in which:

FIG. 1 is a plan view of a composite bag made in accordance with the present invention;

FIG. 2 is a sectional elevation view of the bag taken along line 2—2 in FIG. 1;

FIG. 3 is a sectional elevation view of the bag taken along line 3—3 in FIG. 1;

FIG. 4 is a perspective view of the open end of the bag illustrating support thereof for opening and filling operations;

FIG. 5 is a perspective view of the bag containing a bread product;

FIG. 6 is a plan view schematically illustrating apparatus and a method of manufacturing the bag; and, FIG. 7 is an elevation view of the apparatus as seen along line 7—7 of FIG. 6.

Referring now in greater detail to the drawings wherein the showings are for the purpose of illustrating a preferred embodiment of the invention only and not for the purpose of limiting the invention, FIGS. 1–3 illustrate a composite bag 10 comprised of a first portion 12 of paper and a second portion 14 comprised of plastic films. Portion 12 is in the form of a preformed paper bag having a closed end 16 and an open end 18. Preferably, bag portion 12 is produced from a single sheet of paper material folded longitudinally to provide unpleated side edge folds 20 and 22 and having the side edges of the sheet overlapped and adhesively bonded to produce a single longitudinal seam 24. This provides an unseamed panel 26 on one side of the bag and a seamed panel 28 on the other. The closed end of bag portion 12 is defined by folding a terminal end portion 30 of the seamed tube back into overlapping relationship with the seamed side 28 of the bag and adhesively bonding portion 30 to the latter side. Such a paper bag structure is common and is readily produced on well known bag making machinery in the manner set forth more fully hereinafter.

Second portion 14 of bag 10 is defined by a pair of plastic films 32 and 34 longitudinally overlapping paper bag panels 26 and 28, respectively. Each film is adhesively bonded to the corresponding paper bag panel, and the films are heat sealed or otherwise joined along corresponding opposite side edges thereof to provide a pair of longitudinal seams 36 and 38 contiguous with paper bag side edge folds 20 and 22, respectively. The outer ends of the films are left unattached to define a closable open end for the composite bag. Film 34 extends longitudinally beyond the outer end of film 32 to provide an extension flap 40 which preferably is provided with a pair of apertures 42 for the purpose set forth hereinafter.

As somewhat schematically illustrated in FIG. 4 of the drawing, flap 40 and apertures 42 enable supporting the open end of the composite bag to facilitate the opening thereof for inserting a bread product into the bag. In this respect, it will be appreciated that the composite bag is normally supplied in a flat condition and that the nature of plastic film is such that separation to achieve entrance therebetween is difficult. Flap 40 advantageously provides a single portion of film which can be suitably grasped and held during manipulation of the other film to open the bag. Such opening can for example be achieved by blowing air in the direction of arrow 44 against the junction between outer edge **32*a* of film 32 and the underlying surface of film 34. Apertures 42 adapt the bag for use with hooks or the like 46** by which the bag can be supported during opening with minimal physical handling thus to reduce concerns heretofore expressed with respect to the excessive amount of physical handling of both the bag and bread product required during a packaging operation.

FIG. 5 illustrates a bag 10 of the foregoing structure filled with a hard crusted bread loaf B and closed by means of a well known wire twist-type tie 48. The relative lengths of the bag portion 12 and 14 will of course vary depending on the contour and length of the bread products which, as mentioned herein are of a wide variety of sizes and shapes. Preferably, however, plastic film portion 14 will only expose a short portion of the end of the bread product. Generally, an inch or two, for example, is sufficient for a customer to visually inspect and/or squeeze the product for crust texture. The plastic films will of course have a sufficient length beyond this to enable constriction thereof to receive tie 48. Paper bag portion 12 then provides the desired moisture escape to enable maintaining crust hardness and taste.

Preferably, composite bag 10 is produced in the manner schematically illustrated in FIGS. 6 and 7 of the drawing. In this respect, paper bag portions 12 are continuously produced on standard bag making machinery by which paper 50 on a roll 52 is transferred longitudinally past anvils, not shown, which laterally displace opposite sides 50*a* and 50*b* of the paper toward overlapping relationship. A suitable adhesive applicator 54 applies adhesive to the area of overlap, and the paper tube then passes between rollers or the like to press the bonded area and flaten the tube. A flying knife or the like then severs the paper tube into predetermined lengths, and one end of each cut length is folded to overlie the seamed side panel of the bag and is bonded thereto to define closed end 16 of the paper bag.

The preformed paper bags are then transferred along a path transverse to seam 14 and between films 56 and 58 of plastic material continuously supplied from corresponding rolls. It will be seen that films 56 and 58 have aligned inner edges 56*a* and 58*a* and that film 56 is wider than film 58, thus to provide a portion 56*b* which defines flap extension 40 of the composite bag. As paper bags 12 move toward the converging plastic films, suitable adhesive applicators 60 apply adhesive to the opposite side panels of the paper bag at the open end 18 thereof. Suitable rollers or the like 62 press the films and paper bag together to enhance the bond. The paper bags and films then pass beneath or between suitable heat sealing and severing devices such as hot knife 64 shown in FIGS. 6 and 7. Knife 64 is heated to sever and seal the side edges of films 56 and 58 along lines contiguous with the edge folds of the paper bag portion and to separate the connected bag units into separate composite bags. Apertures 42 in extension flaps 40 can, for example, be introduced such as by suitable punching elements 66 located just ahead of knife 64 in the production line.

The plastic portion of the composite bag is preferably made from films of polyethylene, although other plastic materials such as polypropylene can be used. Preferably, the polyethylene film has a thickness of from about 0.7 to 1.25 mil., which thickness range is preferred to facilitate the bunching or constricting of the plastic portion of the composite bag for the application of a wire twist type or other fastener thereabout. The paper bag portion of the composite bag is preferably made from kraft paper, although other paper material either treated or untreated, such as by waxing, can be employed. Whether the paper material is treated or untreated will depend on the moisture leakage rate desired by the packager for a given hard crusted bread product. In this respect, untreated kraft paper has a moisture leakage rate of about 30 grams per 24 hours, a lightly waxed kraft paper has a leakage rate of from 10–15 grams per 24 hours, and a heavily waxed craft paper has a leakage rate of about 5–8 grams per 24 hours.

Selectivity of the paper may also depend on the relative lengths of the paper and plastic portions of the compoiste bag. In this respect, for example, should it be desired to have half of the length of a bread product exposed beneath the plastic portion of the composite bag, it would be desirable to have the paper bag portion of the composite bag produced from a paper having a high leakage rate to assure sufficient moisture leakage from within the composite bag. The desirability for such a high leakage rate will be appreciated in view of the fact that polyethylene, basically, has a moisture leakage rate of only about 1 gram per 24 hours. It is for this reason that an all plastic bag is undesirable, and it is for this reason too that it is desirable to minimize use of the plastic material in the composite bag to that length required to enable closure of the bag and to enable the minimum exposure of the product necessary to satisfy the customer's desire to see and feel the crust condition.

While considerable emphasis has been placed on the specific structure of the preferred embodiment herein illustrated and disclosed and on the preferred method of making the composite bag, it will be appreciated that other embodiments of the composite bag can be made, that changes can be made in the preferred embodiment, and that the composite bag can be produced other than by the preferred method. All such changes and modifications can be made without departing from the principles of the present invention, and accordingly, it is to be distinctly understood that the foregoing descriptive matter is to be interpreted merely as illustrative of the present invention and not as a limitation.

Having thus described the invention, it is claimed:

1. A pre-formed composite bag for crusted bread products comprising, a first bag portion of paper material having opposite ends and a single longitudinal seam between said ends, portions of the material at one of said ends being secured together to close said one end, and a second bag portion defined by first and second films of plastic material having inner and outer ends and having corresponding opposite side edges longitudinally sealed together providing a pair of parallel longitudinal seams between said inner and outer ends, the other of said opposite ends of said first bag portion being longitudinally received between said inner ends of said films and secured thereto laterally between said pair of seams, and said outer ends of said films providing an opening into said composite bag constrictable to completely enclose an article in said bag.

2. The bag according to claim 1, wherein said outer ends of said first and second plastic films include outer end edges and openings through one of said films adjacent the outer end edge thereof.

3. The bag according to claim 1, wherein said outer ends of said first and second plastic films include outer end edges, said end edges being longitudinally spaced apart for one of said films to be longitudinally longer than the other.

4. The bag according to claim 3, and a pair of openings through said one film between said outer end edges of said films.

5. The bag according to claim 1, wherein the plastic material of at least one of said films is transparent.

6. The bag according to claim 1, wherein said paper material is waxed paper.

7. The bag according to claim 1, wherein said first bag portion has longitudinally extending side edges and a laterally extending end edge at said closed end, each said side edges of said first bag portion being defined by a single longitudinal fold line in said paper material, and said end edge at said closed end being defined by a single fold of said paper material longitudinally toward the other of said ends of said first bag portion.

8. The bag according to claim 7, wherein said longitudinal seams between said plastic films each generally coincides longitudinally with a different one of said side edges of said first bag portion.

9. The bag according to claim 8, wherein said outer ends of said first and second plastic films include outer end edges, said end edges being longitudinally spaced apart for one of said films to be longitudinally longer than the other.

10. The bag according to claim 9, and a pair of openings though said one film between said outer end edges of said films.

11. The bag according to claim 10, wherein the plastic material of at least one of said films is transparent.

12. The bag according to claim 11, wherein said plastic material is polyethylene.

13. The bag according to claim 12, wherein said paper material is a waxed paper.

* * * * *